US012137790B2

(12) United States Patent
Hwang

(10) Patent No.: US 12,137,790 B2
(45) Date of Patent: Nov. 12, 2024

(54) COSMETIC AUTO DROPPER

(71) Applicant: F.S.KOREA INDUSTRIES INC., Seoul (KR)

(72) Inventor: Jae Kwang Hwang, Seoul (KR)

(73) Assignee: F.S.KOREA INDUSTRIES INC., Seoul (KR)

( * ) Notice: Subject to any disclaimer, the term of this patent is extended or adjusted under 35 U.S.C. 154(b) by 338 days.

(21) Appl. No.: 17/725,475

(22) Filed: Apr. 20, 2022

(65) Prior Publication Data

US 2022/0395074 A1 Dec. 15, 2022

(30) Foreign Application Priority Data

Jun. 11, 2021 (KR) ..... 10-2021-0076295

(51) Int. Cl.
*A45D 34/04* (2006.01)

(52) U.S. Cl.
CPC ..... *A45D 34/04* (2013.01); *A45D 2200/054* (2013.01)

(58) Field of Classification Search
CPC ..... B65D 47/18; A45D 34/04
See application file for complete search history.

(56) References Cited

U.S. PATENT DOCUMENTS

2013/0074983 A1* 3/2013 Choi ..... B05B 11/1047 141/23
2013/0192713 A1* 8/2013 Drugeon ..... B65D 51/32 141/26
2021/0112945 A1* 4/2021 Jacob ..... A45D 34/04
2021/0206542 A1* 7/2021 Kim ..... A45D 34/00
2024/0092542 A1* 3/2024 Kim ..... A45D 34/04

* cited by examiner

*Primary Examiner* — Jeremy Carroll
(74) *Attorney, Agent, or Firm* — Heedong Chae; Lucem, PC

(57) ABSTRACT

Disclosed is a cosmetic auto dropper. The cosmetic auto dropper of the present disclosure includes a container body provided with a container body in which a cosmetic liquid is stored and a pipette member which is disposed in the container body to suck or discharge the cosmetic liquid; a cap part provided with an inner cap coupled to the container body and an outer cap coupled to the inner cap; a pumping part which is elevated from the inner cap and the outer cap to suck or discharge the cosmetic liquid in the container body into or from the pipette member; and an elastic part which has one side connected to the pumping part and the other side supported by the inner cap to elastically support the pumping part, wherein the lower end of the elastic part is supported by an extension of the inner cap.

8 Claims, 9 Drawing Sheets

COSMETIC AUTO DROPPER

CROSS-REFERENCE TO RELATED APPLICATIONS

This application claims the priority of Korean Patent Application No. 10-2021-0076295 filed on Jun. 11, 2021, in the Korean Intellectual Property Office, the disclosure of which is incorporated herein by reference.

BACKGROUND OF THE INVENTION

Field of the Invention

The present disclosure relates to a cosmetic auto dropper, and more particularly, to a cosmetic auto dropper capable of sucking out and using a cosmetic liquid by a piston method and stably supporting a pumping means for pumping the cosmetic liquid.

Description of the Related Art

In general, as a method of using liquid cosmetic contents such as cosmetics, which preferably use a small amount of eye cream and the like at a time, but use a precise quantity, in the related art, a method of individually packaging the contents in the form of a capsule or the like by an amount to be used for each use time was used.

However, such an individual packaging method has a problem in that it is inefficient because a relatively large amount thereof remains in the capsule even after a user uses the cosmetic contents.

In order to overcome the problems of such an individual packaging method, after the contents are received in a container, there is disclosed a configuration of extracting the cosmetic contents every use by using an extracting means having a general pipette or syringe structure or using an extracting means having a configuration of a push pump.

Meanwhile, when the cosmetic contents are extracted by using the extracting means of a conventional syringe structure, it is inconvenient because an area coupled with the piston is exposed to the outside of the container and it is unsanitary because foreign substances may be stained on the exposed area, so that the improvement thereof is required.

In particular, since the convenience of use may be improved when a pumping driving part for pumping cosmetic contents is stably elevated, improvement measures are also required.

The above-described technical configuration is the background art for helping in the understanding of the present disclosure, and does not mean a conventional technology widely known in the art to which the present disclosure pertains.

SUMMARY OF THE INVENTION

Therefore, the present disclosure has been made in efforts to provide a cosmetic auto dropper capable of sucking out and using a cosmetic liquid by a piston method and stably supporting a pumping means for pumping the cosmetic liquid.

According to an aspect of the present disclosure, there is provided a cosmetic auto dropper including: a container body provided with a container body in which a cosmetic liquid is stored and a pipette member which is disposed in the container body to suck or discharge the cosmetic liquid; a cap part provided with an inner cap coupled to the container body and an outer cap coupled to the inner cap; a pumping part which is elevated from the inner cap and the outer cap to suck or discharge the cosmetic liquid in the container body into or from the pipette member; and an elastic part which has one side connected to the pumping part and the other side supported by the inner cap to elastically support the pumping part, wherein the lower end of the elastic part is supported by an extension of the inner cap.

The elastic part may include a pressing body which has one side connected to the outer cap and the other side connected to the pumping part and is lowered together with the pumping part when lowering the pumping part; and an elastic body which has one side supporting the pressing body and the other side supported by the extension and is pressed and contracted by the pressing body when lowering the pumping part.

The elastic body may include a first ring having a lower surface portion supported by the inner cap; a second ring which supports the lower end of the pressing body and is spaced apart from the first ring; and a connection part for connecting the first ring and the second ring.

The connection part may include a first vertical portion provided vertically to the upper surface of the first ring; an inclined portion provided to be bent at the upper end of the first vertical portion; and a second vertical portion which is bent in the direction of the second ring at the end of the inclined portion and is provided vertically to the second ring.

An elevating guide hole may be provided in the pressing body, and a rotation guide protrusion provided on the outer cap may be inserted into the elevating guide hole to be rotated together with the pressing body when rotating the outer cap.

The elevating guide hole may be provided in a height direction of the pressing body and may be provided higher than the rotation guide protrusion to guide the elevating of the pressing body.

A support protrusion may be provided in the pressing body, first hole, a second hole, and a third hole may be provided in the pumping part to communicate with each other, the first hole may be provided at the lowest position of the pumping part, the lower end of the second hole may communicate with the first hole and the upper end of the second hole may be provided to be inclined in a height direction of the pumping unit, and the third hole may communicate with the upper end of the second hole and may be provided in parallel with the first hole, and when the position of the pumping part is fixed, the support protrusion may move to the third hole through the first hole and the second hole and engage with the third hole to fix the position of the pumping part.

An inner post and an outer post may be provided in the inner cap to be spaced apart from each other, and a guide post may be provided in the pumping part so that the lower side is inserted and elevated between the inner post and the outer post.

An elevating guide protrusion may be provided on the pumping part, and the elevating guide protrusion may be elevated along an elevating guide slot provided in the inner cap to guide the elevating of the pumping part.

The elastic body of the elastic part may be made of a material including plastic.

According to the embodiments of the present disclosure, it is possible to stably support a pumping part for pumping a cosmetic liquid by an elastic part which has one side connected to the pumping part and the other side supported by the inner cap to elastically support the pumping part, and to suck out and use the cosmetic liquid by a piston method.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
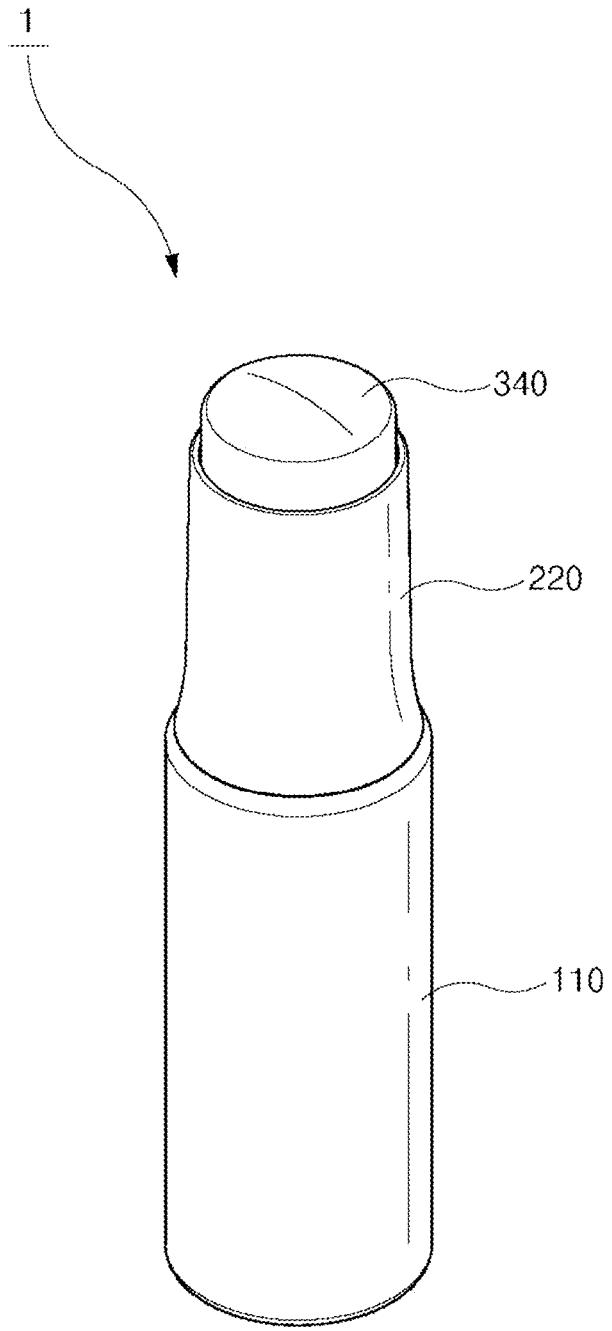
FIG. 1 is a perspective view illustrating a cosmetic auto dropper according to an embodiment of the present disclosure.

In order to fully understand the present disclosure, operational advantages of the present disclosure and objects to be achieved by implementing the present disclosure, the present disclosure will be described with reference to the accompanying drawings which illustrate preferred embodiments of the present disclosure and the contents illustrated in the accompanying drawings.

Hereinafter, preferred embodiments of the present disclosure will be described in detail with reference to the accompanying drawings. Like reference numerals illustrated in the respective drawings designate like members.

Figure 2:
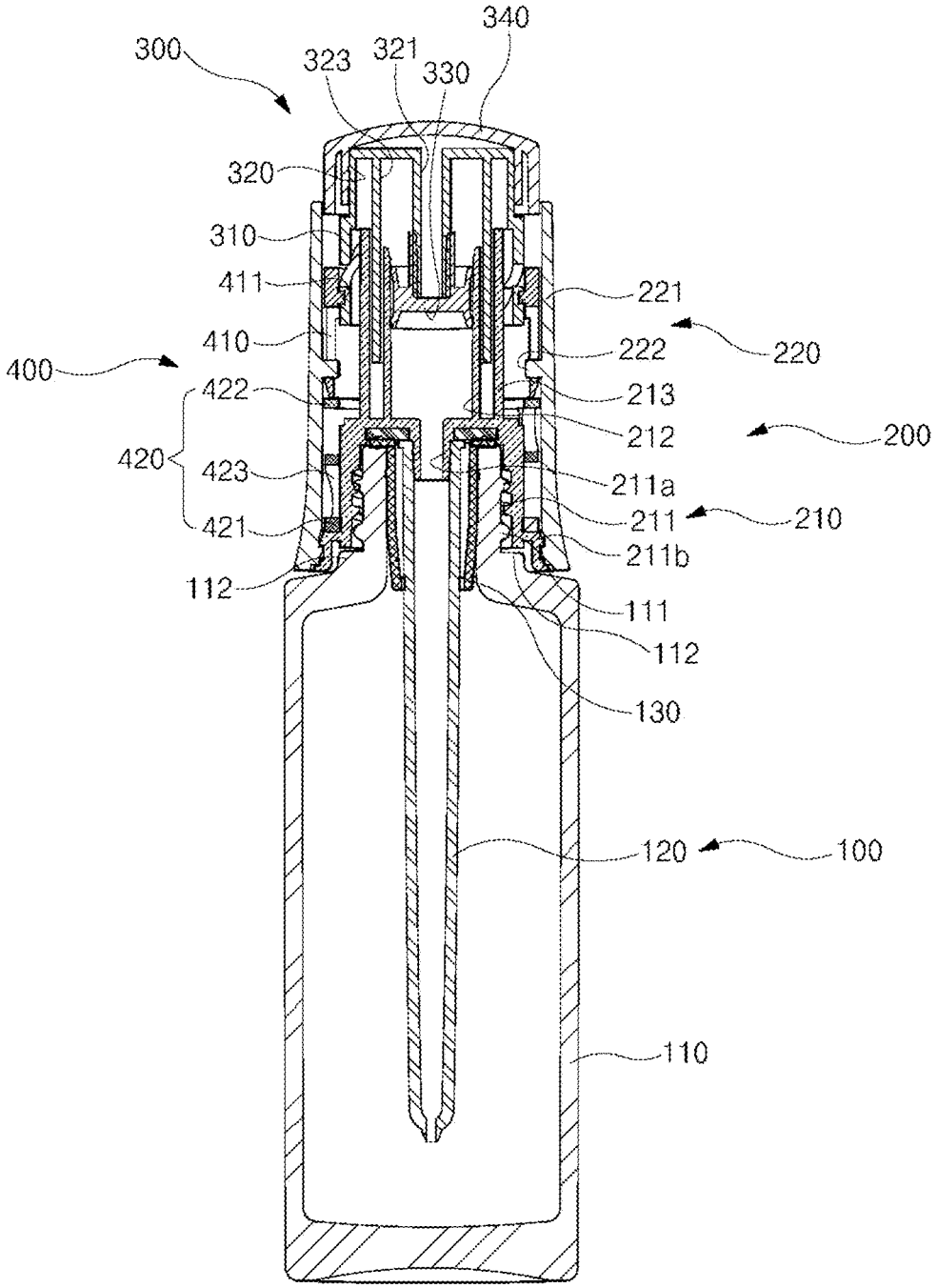
FIG. 2 is a cross-sectional view of FIG. 1.
Figure 3:
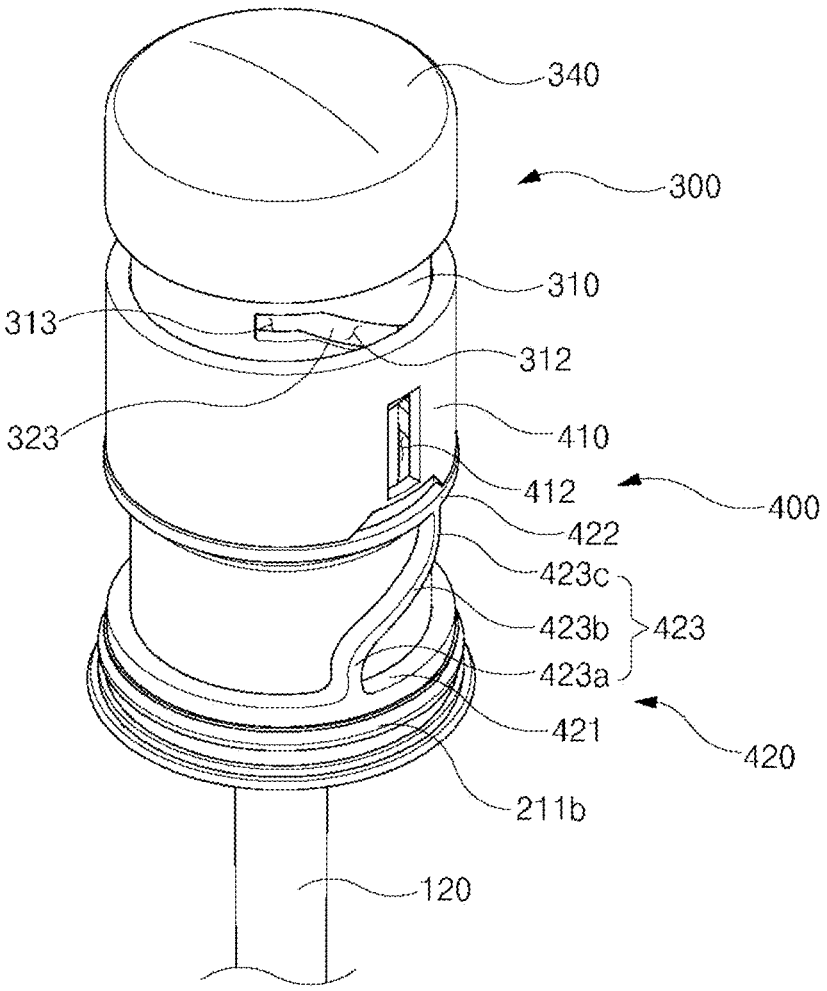
FIG. 3 is a perspective view illustrating main parts of the present embodiment.
Figure 4:
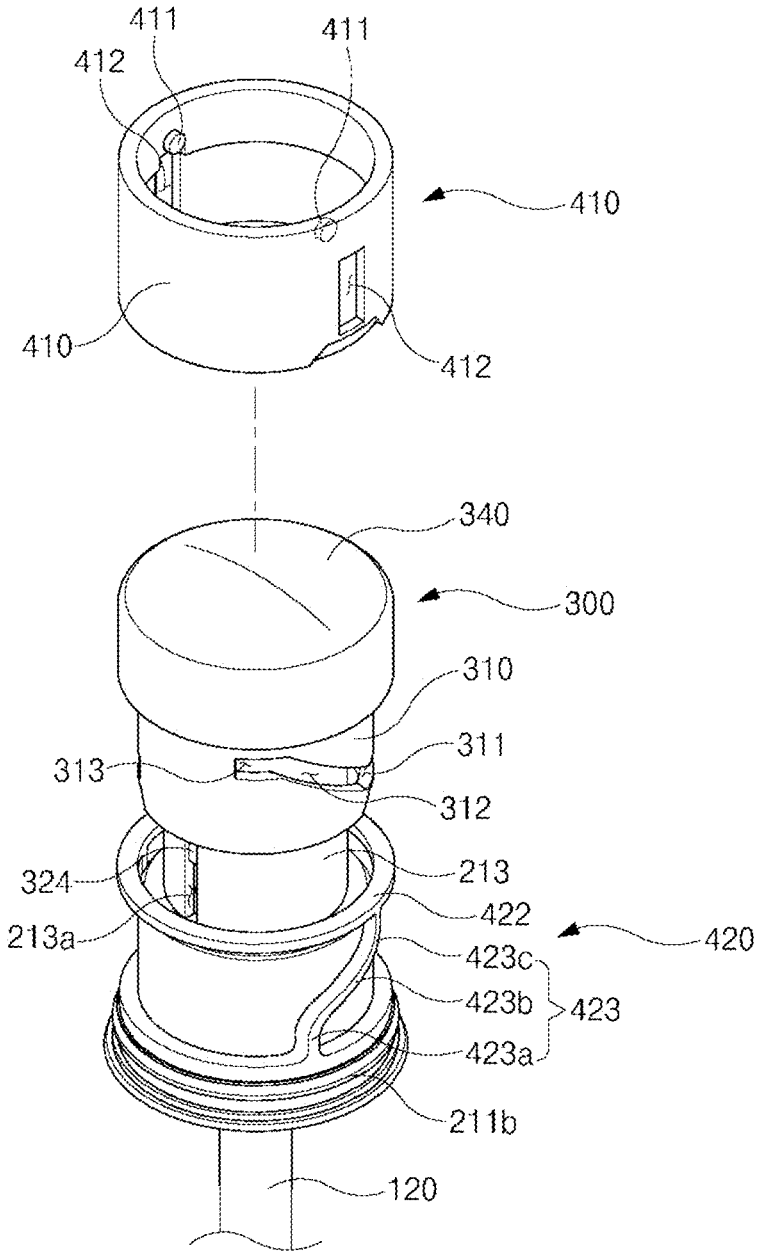
FIG. 4 is a diagram illustrating a state in which a pressing body is exploded in FIG. 3.
Figure 5:
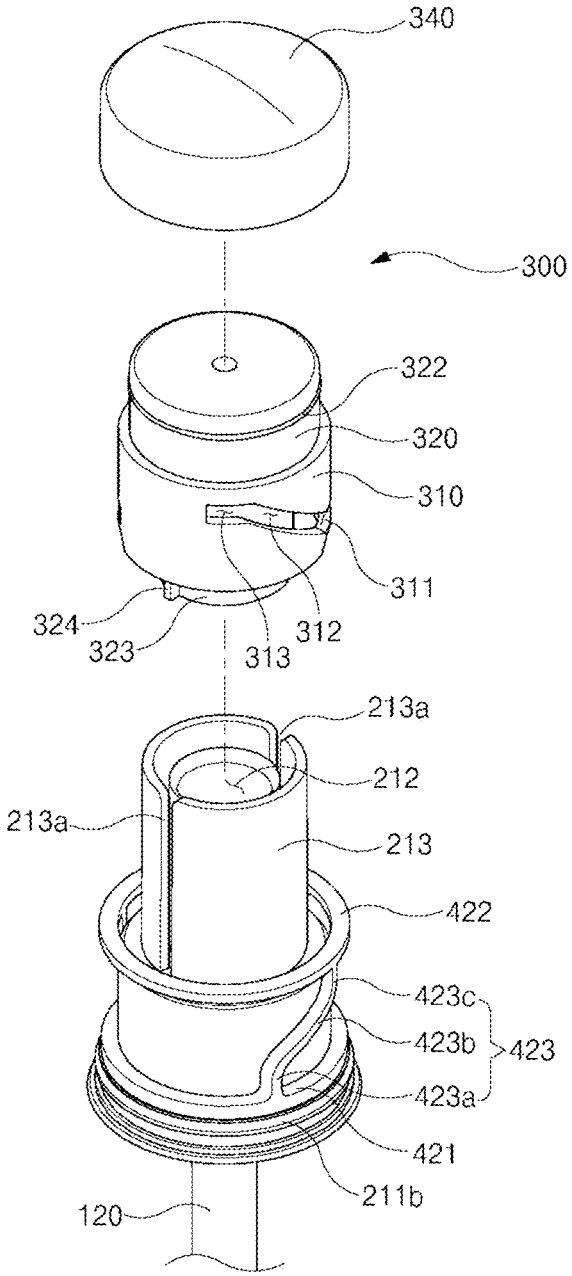
FIG. 5 is a diagram illustrating a state in which a pumping part illustrated in FIG. 4 is separated.

FIG. 1 is a perspective view illustrating a cosmetic auto dropper according to an embodiment of the present disclosure, FIG. 2 is a cross-sectional view of FIG. 1, FIG. 3 is a perspective view illustrating main parts of the present embodiment, FIG. 4 is a diagram illustrating a state in which a pressing body is exploded in FIG. 3, and FIG. 5 is a diagram illustrating a state in which a pumping part illustrated in FIG. 4 is separated.

Figure 6:
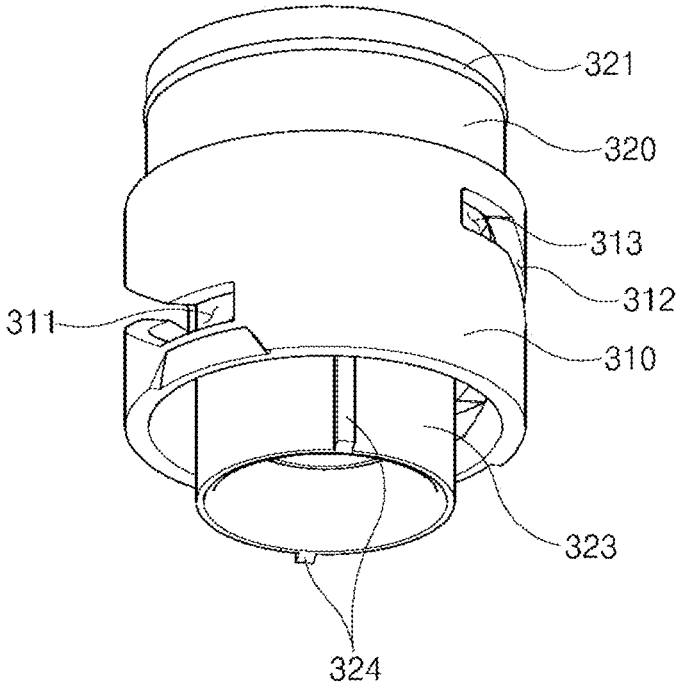
FIG. 6 is a bottom perspective view of the pumping part illustrated in FIG. 5.
Figure 7:
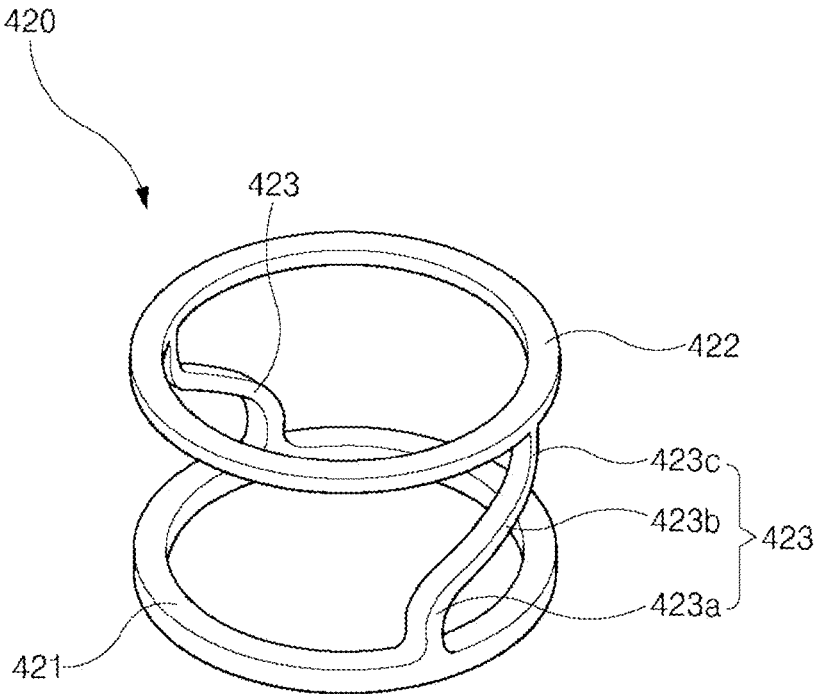
FIG. 7 is a perspective view illustrating an elastic body illustrated in FIG. 3.
Figure 8:
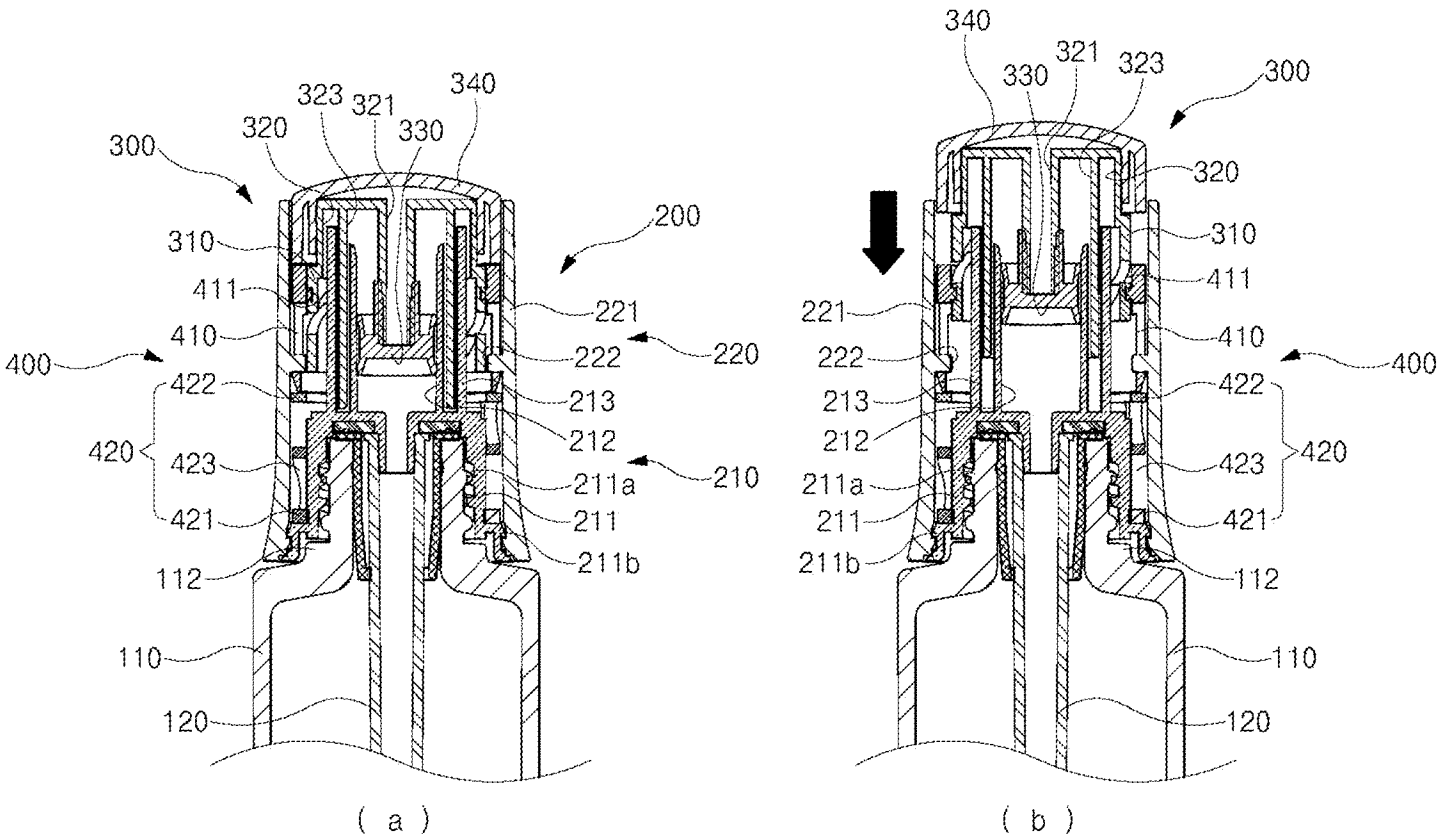
FIG. 8 is a diagram illustrating a state in which the pumping part is lifted to suck the cosmetic liquid into a pipette member, as an operation diagram of the present embodiment.
Figure 9:
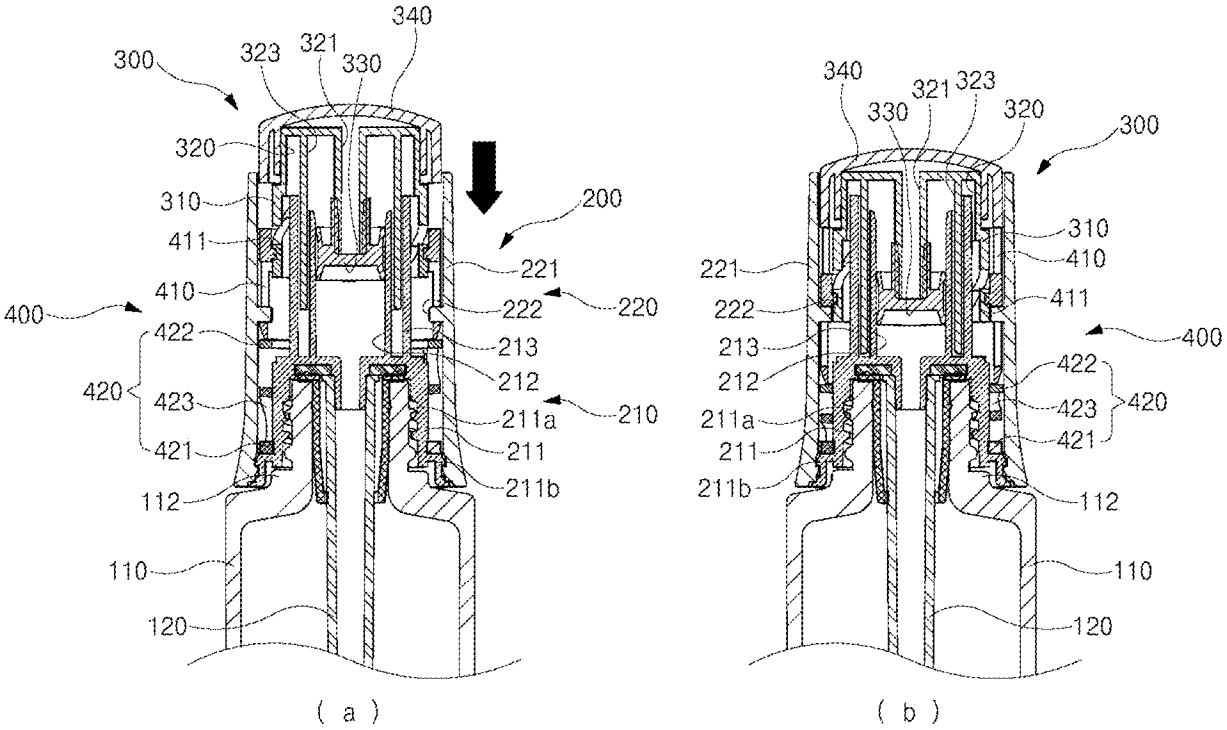
FIG. 9 is a diagram illustrating a state in which the cosmetic liquid is discharged to the outside of the pipette member while the elastic body is contracted by lowering the pumping part, as an operation diagram of the present embodiment.

In addition, FIG. 6 is a bottom perspective view of the pumping part illustrated in FIG. 5, FIG. 7 is a perspective view illustrating an elastic body illustrated in FIG. 3, FIG. 8 is a diagram illustrating a state in which the pumping part is lifted to suck the cosmetic liquid into a pipette member, as an operation diagram of the present embodiment; and FIG. 9 is a diagram illustrating a state in which the cosmetic liquid is discharged to the outside of the pipette member while the elastic body is contracted by lowering the pumping part, as an operation diagram of the present embodiment.

As illustrated in the drawings, a cosmetic auto dropper 1 according to the embodiment includes a container body 100 in which a cosmetic liquid is stored, a cap part 200 coupled to the container body 100, a pumping part 300 which is elevated from the cap part 200 to suck or discharge the cosmetic liquid in the container body 100 into or from a pipette member 120, and an elastic part 400 which has one side connected to the pumping part 300 and the other side supported by the cap part 200 to elastically support the pumping part 300.

As illustrated in FIG. 2, the container body 100 includes the container body 110 in which the cosmetic liquid is stored, the pipette member 120 which is disposed in the container body 110 to suck or discharge the cosmetic liquid, a wiper 130 which is coupled to a body head 111 of the container body 110 to remove the cosmetic contents on the outer wall of the pipette member, and a packing member 140 which has an upper surface portion supported by an inner cap body 211 of an inner cap 210 and a lower surface portion supported with the pipette member 120 and the upper surface portion of the wiper 130.

The cosmetic liquid is stored in the container body 110 of the container body 100, and the cosmetic liquid stored in the container body 110 may be discharged to the user's hand or face, and the like through the pipette member 120.

In the embodiment, at the upper end of the container body 110, as illustrated in FIG. 2, the body head 111 is provided with a smaller diameter than the container body 110, and a thread provided on the body head 111 may be screwed with a thread provided the inner cap body 211 of the inner cap 210.

In addition, in the embodiment, as illustrated in FIG. 2, the container body 110 may be provided with a pair of support blocks 112 to support the lower end of the inner cap 210.

As illustrated in FIG. 2, the pipette member 120 of the container body 100 is coupled to a pipette coupling part 211*a* of the inner cap body 211, and sucks the cosmetic liquid stored in the container body 110 by the operation of the pumping part 300 to be discharged onto the user's skin.

In addition, in the embodiment, the pipette member 120 may be detachably fitted and coupled to the pipette coupling part 211*a*.

As illustrated in FIG. 2, the packing member 140 of the container body 100 has an upper surface portion supported by the inner cap body 211 of the inner cap 210 and a lower surface portion supported with the pipette member 120 and the upper surface portion of the wiper 130 to elastically support the inner cap body 211 and prevent the cosmetic liquid from being leaked from the inner cap body 211.

The cap part 200, as illustrated in FIG. 2, may include an inner cap 210 coupled to the container body 110 and an outer cap 220 coupled to the inner cap 210.

The inner cap 210 of the cap part 200 includes an inner cap body 211 screwed to the body head 111, an inner post 212 provided to extend upward from the inner cap body 211 to support the pumping part 300, and an outer post 213 provided on the inner cap body 211 to be spaced apart from the inner post 212 to support the pumping part 300 together with the inner post 212.

In the embodiment, as illustrated in FIG. 2, the pipette coupling part 211*a* is provided on the lower surface portion of the inner cap body 211, and the pipette member 120 may be detachably fitted to the pipette coupling part 211*a*.

In addition, in the embodiment, on the outer wall of the lower end of the inner cap body 211, as illustrated in FIG. 2, an extension 211*b* is provided to support the lower surface portion of the elastic body 420, that is, the lower surface portion of a first ring 421.

As illustrated in FIG. 2, the height of the upper end of the inner post 212 of the inner cap 210 may be lower than the height of the upper end of the outer post 213.

In the embodiment, in the outer post 213, as illustrated in FIG. 4, an elevating guide slot 213*a* is provided from the upper end to the lower portion of the outer post 213, and as illustrated in FIG. 4, an elevating guide protrusion 324 provided in the pumping part 300 may be inserted and supported to the elevating guide slot 213*a*.

In addition, in the embodiment, between the inner post 212 and the outer post 213, as illustrated in FIG. 2, a guide post 323 provided in the pumping part 300 may be inserted and supported.

As illustrated in FIG. 2, the outer cap 220 of the cap part 200 is coupled to the inner cap 210 and the pressing body 410 to rotate the pressing body 410 so that the pressing body 410 is elevated.

In the embodiment, as illustrated in FIG. 2, the outer cap 220 includes an outer cap body 221 in which the lower portion is rotatably fitted to the extension 211*b* of the inner cap 210 by a protrusion and a groove, and a rotation guide protrusion 222 which is provided on the inner wall of the central portion of the outer cap body 221 to be inserted into an elevating guide hole 412 provided in the pressing body 410.

In the embodiment, the horizontal length of the rotation guide protrusion 222 is provided to correspond to the horizontal length of the elevating guide hole 412 illustrated in FIG. 3 so that the pressing body 410 may be rotated in the same direction as the outer cap 220 when rotating the outer cap.

In addition, in the embodiment, the vertical length of the rotation guide protrusion 222 may be provided to be smaller than the length of the elevating guide hole 412 to provide a space in which the pressing body 410 may be elevated (lifted or lowered).

The pumping unit 300 is elevated from the inner cap 210 and the outer cap 220 by the rotational force of a user to suck the cosmetic liquid stored in the container body 110 into the pipette member 120 or discharge the cosmetic liquid in the pipette member 120 to the outside of the pipette member 120.

In the embodiment, as illustrated in FIG. 8, the pumping part 300 includes a base body 310 elevated while engaging with the support protrusion 411 of the pressing body 410, a coupling body 320 provided above the base body 310 and supported by the inner cap 210 during elevating, a piston member 330 coupled to the coupling body 320, and a cap member 340 coupled to the upper portion of the coupling body 320 to be provided as a pressing space of the user.

As illustrated in FIG. 4, in the base body 310 of the pumping unit 300, a first hole 311, a second hole 312, and a third hole 313 may be provided to communicate with each other.

In the embodiment, as illustrated in FIG. 4, the first hole 311 is provided at the lowest position of the pumping part 300, the lower end of the second hole 312 communicates with the first hole 311 and the upper end of the second hole 312 is provided to be inclined in a height direction of the pumping unit 300, and the third hole 313 may communicate with the upper end of the second hole 312 and may be provided in parallel with the first hole 311. When the position of the pumping part 300 is fixed, the support protrusion 411 provided on the pressing body 410 moves to the third hole 313 through the first hole 311 and the second hole 312 and engages with the third hole to fix the position of the pumping part 300.

As illustrated in FIG. 2, a coupling post 321 is provided in the coupling body 320 of the pumping part 300 and the piston member 330 may be forcibly fitted to the coupling post 321.

In the embodiment, as illustrated in FIG. 5, a coupling protrusion 322 is provided on the outer wall of the coupling body 320, and the coupling protrusion 322 may be fitted into a groove provided on the inner wall of the cap member 340.

In addition, in the embodiment, as illustrated in FIG. 2, a guide post 323 may be provided on the coupling body 320 at a position spaced apart from the coupling post 321. In the embodiment, the guidepost 323 may be disposed between the inner post 212 and the outer post 213 to guide the elevating of the pumping part 300.

Further, in the embodiment, on the outer wall of the guide post 323, as illustrated in FIG. 6, a pair of elevating guide protrusions 324 may be provided to be spaced apart from each other. In the embodiment, as illustrated in FIG. 4, the elevating guide protrusion 324 may be inserted into the elevating guide slot 213*a* to be elevated in the height direction of the elevating guide slot 213*a*.

As illustrated in FIG. 2, the elastic part 400 may have one side connected to the pumping part 300 and the other side supported by the inner cap 210 to elastically support the pumping part 300.

In the embodiment, as illustrated in FIG. 2, the elastic part 400 includes a pressing body 410 which has one side connected to the outer cap 220 and the other side connected to the pumping part 300 and is lowered with the pumping part 300 when lowering the pumping part 300, and an elastic body 420 which has one side for supporting the pressing body 410 and the other side supported by the inner cap 210 and is pressed and contracted by the pressing body 410 when lowering the pumping part 300.

As illustrated in FIG. 4, the pressing body 410 of the elastic part 400 may have a hollow cylindrical shape.

In the embodiment, on the inner wall of the pressing body 410, as illustrated in FIG. 4, a pair of support protrusions 411 may be provided to be spaced apart from each other. In the embodiment, when the position of the pumping part 300 is fixed, the pair of support protrusions 411 move to the third hole 313 through the first hole 311 and the second hole 312 and then engages with the third hole 313 to fix the position of the pumping part 300. In the embodiment, a pair of first holes 311, a pair of second holes 312, and a pair of third holes 313 may be provided, respectively.

In addition, in the embodiment, as illustrated in FIG. 4, a pair of elevating guide holes 412 may be provided on the pressing body 410. In the embodiment, a rotation guide protrusion 222 of the outer cap 220 may be inserted into the elevating guide hole 412. In the embodiment, the horizontal length of the rotation guide protrusion 222 is provided to correspond to the horizontal length of the elevating guide hole 412 as described above so that the pressing body 410 may also be rotated in the same direction as the outer cap 220 when rotating the outer cap. In addition, in the embodiment, the vertical length of the rotation guide protrusion 222 may be provided to be smaller than the length of the elevating guide hole 412 to provide a space in which the pressing body 410 may be elevated.

The elastic body 420 of the elastic part 400 is pressed by the pressing body 410 to discharge the cosmetic liquid sucked into the pipette member 120 to the outside of the pipette member 120 while being pressed as illustrated in FIG. 9B.

In the embodiment, as illustrated in FIG. 2, the elastic body 420 includes a first ring 421 having a lower surface portion supported by the inner cap 210, a second ring 422 which supports the lower end of the pressing body 410 and is spaced apart from the first ring 421, and a connection part 423 connecting the first ring 421 and the second ring 422.

In the embodiment, as illustrated in FIG. 7, the connection part 423 includes a first vertical portion 423*a* provided vertically to the upper surface of the first ring 421, an inclined portion 423*b* provided to be bent at the upper end of the first vertical portion 423*a*, and a second vertical portion 423*c* which is bent in the direction of the second ring 422 at the end of the inclined portion 423*b* and is provided vertically to the second ring 422.

Hereinafter, the operation of the embodiment will be briefly described with reference to FIGS. 8 and 9.

First, FIG. 8A illustrates a state in which the pumping part 300 is locked. In this state, when the outer cap 220 is rotated, while the support protrusion 411 provided on the pressing body 410 is lowered along the third hole 313, the second hole 312, and the first hole 311, the pumping part 300 may be elevated, as illustrated in FIG. 8B.

In this state, while the pumping part 300 is lowered when the cap member 340 of the pumping part 300 is pressed downward, the pressing body 410 is pressed downward and the pressing body 410 may contract the elastic body 420 as illustrated in FIG. 9B. In this state, the cosmetic liquid in the pipette member 120 may be discharged to the outside of the pipette member 120.

As described above, the present disclosure is not limited to the embodiments described herein, and it will be apparent to those skilled in the art that various changes and modifications may be made without departing from the spirit and the scope of the present disclosure. Therefore, it will be understood that these changes and modifications are included in the appended claims of the present disclosure.

What is claimed is:

1. A cosmetic auto dropper comprising:

a container body provided with a container in which a cosmetic liquid is stored and a pipette member which is disposed in the container to suck or discharge the cosmetic liquid;

a cap part provided with an inner cap coupled to the container body and an outer cap coupled to the inner cap;

a pumping part which is elevated from the inner cap and the outer cap to suck or discharge the cosmetic liquid in the container into or from the pipette member; and an elastic part which has one side connected to the pumping part and the other side supported by the inner cap to elastically support the pumping part, wherein the lower end of the elastic part is supported by an extension of the inner cap, wherein the elastic part comprises:

a pressing body which has one side connected to the outer cap and the other side connected to the pumping part and is lowered together with the pumping part when lowering the pumping part; and an elastic body which has one side supporting the pressing body and the other side supported by the extension and is pressed and contracted by the pressing body when lowering the pumping part, wherein an elevating guide hole is provided in the pressing body, and a rotation guide protrusion provided on the outer cap is inserted into the elevating guide hole to be rotated together with the pressing body when rotating the outer cap.

2. The cosmetic auto dropper of claim 1, wherein the elastic body comprises a first ring having a lower surface portion supported by the inner cap;

a second ring which supports the lower end of the pressing body and is spaced apart from the first ring; and a connection part for connecting the first ring and the second ring.

3. The cosmetic auto dropper of claim 2, wherein the connection part comprises a first vertical portion provided vertically to the upper surface of the first ring;

an inclined portion provided to be bent at the upper end of the first vertical portion; and a second vertical portion which is bent in the direction of the second ring at the end of the inclined portion and is provided vertically to the second ring.

4. The cosmetic auto dropper of claim 1, wherein the elevating guide hole is provided in a height direction of the pressing body and is provided higher than the rotation guide protrusion to guide the elevating of the pressing body.

5. The cosmetic auto dropper of claim 1, wherein a support protrusion is provided in the pressing body, a first hole, a second hole, and a third hole are provided in the pumping part to communicate with each other, the first hole is provided at the lowest position of the pumping part, the lower end of the second hole communicates with the first hole and the upper end of the second hole is provided to be inclined in a height direction of the pumping unit, and the third hole communicates with the upper end of the second hole and is provided in parallel with the first hole, and when the position of the pumping part is fixed, the support protrusion moves to the third hole through the first hole and the second hole and engages with the third hole to fix the position of the pumping part.

6. The cosmetic auto dropper of claim 1, wherein the elastic body of the elastic part is made of a material including plastic.

7. A cosmetic auto dropper comprising:

a container body provided with the container in which a cosmetic liquid is stored and a pipette member which is disposed in the container to suck or discharge the cosmetic liquid;

a cap part provided with an inner cap coupled to the container body and an outer cap coupled to the inner cap;

a pumping part which is elevated from the inner cap and the outer cap to suck or discharge the cosmetic liquid in the container; and an elastic part which has one side connected to the pumping part and the other side supported by the inner cap to elastically support the pumping part, wherein the lower end of the elastic part is supported by an extension of the inner cap, wherein an inner post and an outer post are provided in the inner cap to be spaced apart from each other, and a guide post is provided in the pumping part so that the lower side is inserted and elevated between the inner post and the outer post.

8. A cosmetic auto dropper comprising:

a container body provided with the container in which a cosmetic liquid is stored and a pipette member which is disposed in the container to suck or discharge the cosmetic liquid;

a cap part provided with an inner cap coupled to the container body and an outer cap coupled to the inner cap;

a pumping part which is elevated from the inner cap and the outer cap to suck or discharge the cosmetic liquid in the container; and an elastic part which has one side connected to the pumping part and the other side supported by the inner cap to elastically support the pumping part, wherein the lower end of the elastic part is supported by an extension of the inner cap, wherein an elevating guide protrusion is provided on the pumping part, and the elevating guide protrusion is elevated along an elevating guide slot provided in the inner cap to guide the elevating of the pumping part.

* * * * *